United States Patent [19]

Trevino

[11] Patent Number: 5,056,621

[45] Date of Patent: Oct. 15, 1991

[54] FLUID TRANSFER APPARATUS AND METHOD

[76] Inventor: Arnold G. Trevino, 1702-A Future Dr., Austin, Tex. 78754

[21] Appl. No.: 434,026

[22] Filed: Nov. 9, 1989

[51] Int. Cl.[5] ..... F16N 33/00

[52] U.S. Cl. ..... 184/1.5; 123/196 R

[58] Field of Search ..... 184/1.5; 123/196 R, 123/196 S; 222/372, 383

[56] References Cited

U.S. PATENT DOCUMENTS

| | | | |
|---|---|---|---|
| 2,029,781 | 2/1936 | McLean | 184/1.5 |
| 2,603,312 | 7/1952 | Tabet | 184/1.5 |
| 4,240,523 | 12/1980 | Nestor | 184/1.5 |
| 4,285,360 | 8/1981 | Bauer | 184/1.5 |
| 4,354,574 | 10/1982 | Kieber | 184/1.5 |
| 4,491,103 | 1/1985 | Deadman | 123/196 S |
| 4,508,195 | 4/1985 | Millet | 184/1.5 |
| 4,739,861 | 4/1988 | Desjardins | 184/1.5 |
| 4,909,205 | 3/1990 | Bewley | 184/1.5 |

*Primary Examiner*—Ira S. Lazarus

*Assistant Examiner*—Alan B. Cariaso

*Attorney, Agent, or Firm*—J. Nevin Shaffer, Jr.; Russell D. Culbertson

[57] ABSTRACT

A fluid transfer apparatus and method employing an electric pump with one discharge port and one or more suction ports connected to corresponding discharge conduit and suction conduits. By means of a switch, suction can be directed from one suction conduit to the other as required. The operator simply directs the flow of the contaminated oil to a suitable receptacle, energizes the system and provides suction on the oil pan through an oil plug adapter and old oil is removed. New oil is added by switching suction to another suction conduit and directing the discharge port to connection with an oil cap adapter so that new oil can flow through the discharge conduit into a vehicle through an oil cover adapter. Not only oil, but other automotive fluids can be removed and added to the vehicle by means of this invention. As a result, a safe and ecologically respectful and cost efficient means is provided for the transfer of automotive fluids into and out of a vehicle.

9 Claims, 5 Drawing Sheets

36
38
ON
OFF
44
46
28
IN
OUT
42
12
32
40
40
30
48
56
60
58
10
54

FIG. 2
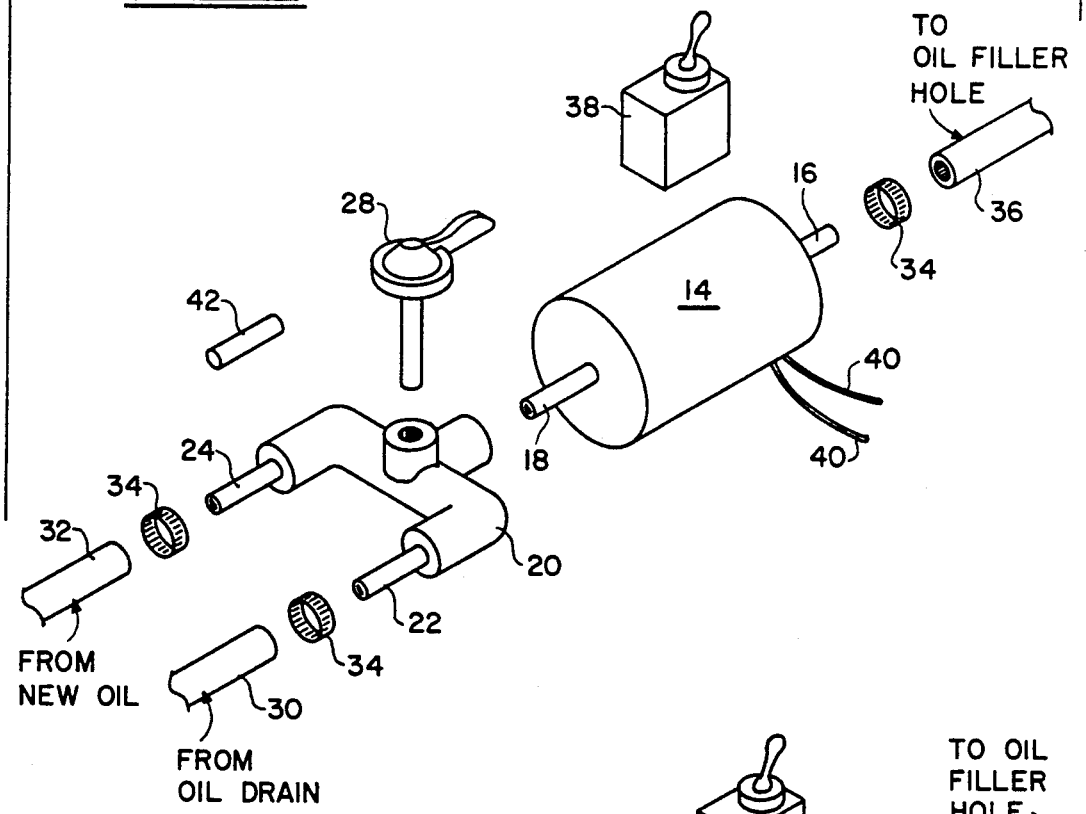
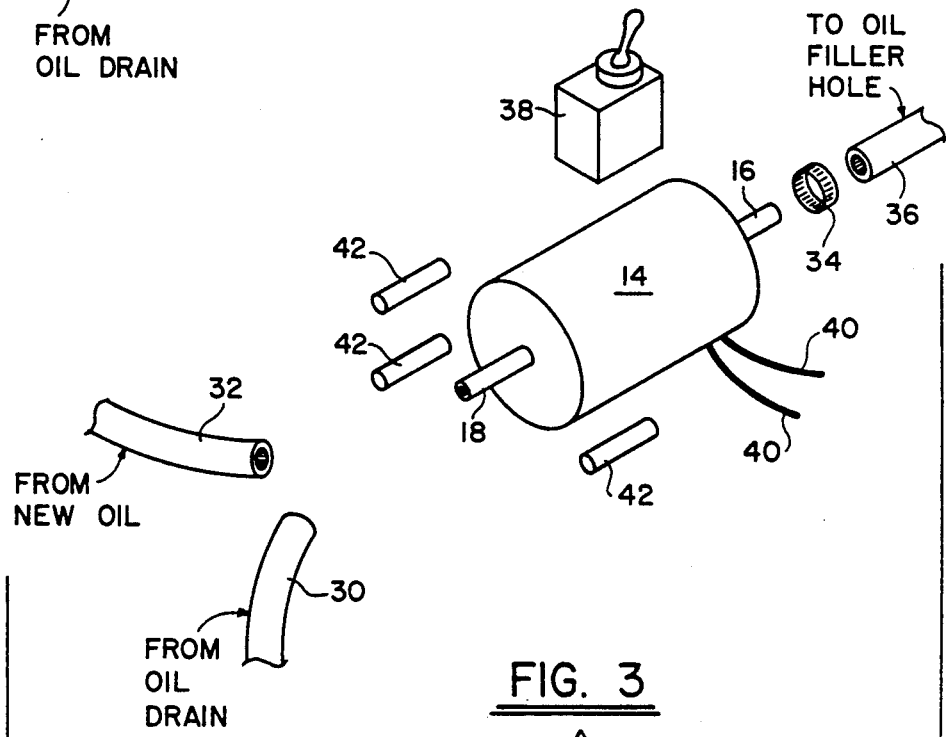
FIG. 3

36
44
46
38
42
42
42
12
40
32
40
30
50
48
56
60
58
54

FIG. 7
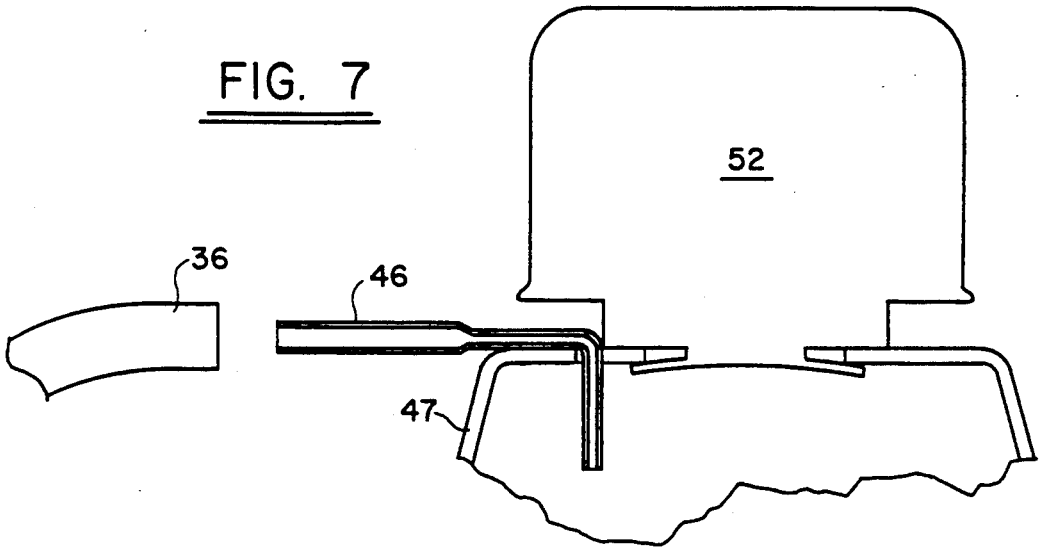
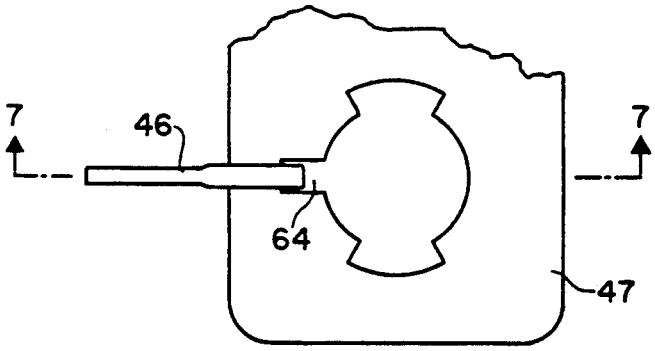
FIG. 6
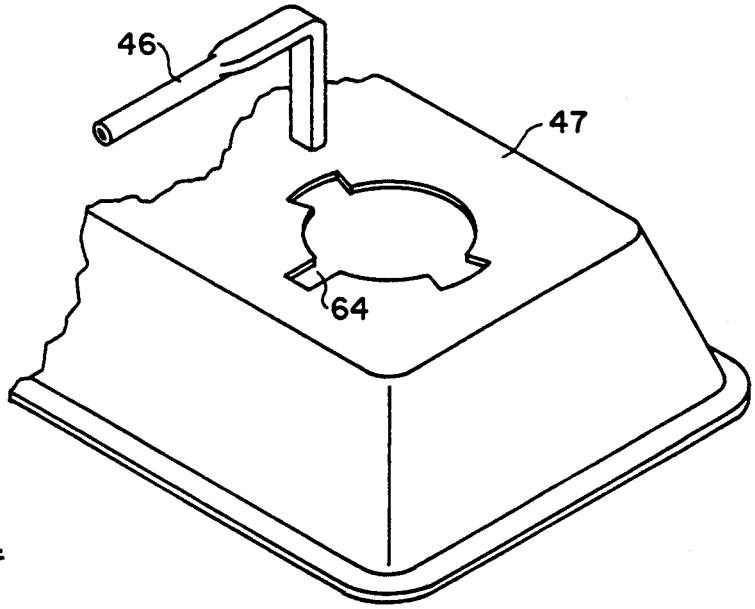
FIG. 8

FLUID TRANSFER APPARATUS AND METHOD

BACKGROUND OF THE INVENTION

This invention relates to an improved fluid transfer mechanism and method for easily transferring and replacing fluids.

A wide variety of both manual and automatically driven transfer mechanisms have been known in the art for quite some time. As long as vehicles, in particular the automobile, have existed it has been critically important to their smooth operation and continued functioning that the various fluids used to lubricate and motivate the vehicle be replaced regularly. To change fluids in automobiles, for example, a number of activities are required all of which involved special tools, knowledge and skills. In many cases it is required to lift the automobile up or to crawl underneath it in order to reach the necessary points in the engine compartment for the particular fluid involved. For example, changing the motor oil, in the conventional manner, requires that the automobile be lifted up so that the drain plug can be reached in the bottom of the oil pan. After the oil has been drained out, the plug is replaced and the automobile is lowered down and the new oil is replaced through the conventional opening at the valve cover on top of the engine by pouring the oil into the top of the engine. Because of this, most individuals do not attempt to change the motor oil themselves.

Another fluid that is regularly changed, is the radiator fluid in a vehicle. This fluid is generally changed seasonally. Once again it requires knowledge of where the inlet and outlet plugs on the radiator are located and the proper equipment to make the change easily. Additionally, as with the motor oil, and in particular with radiator fluid that may contain antifreeze, there is an ecological problem with the waste. That is, it is easy to open the radiator plug and simply let the radiator fluid drain out. In this day and age however, this procedure is less and less acceptable and, in fact, illegal in some places. As a result, there is a need for a simple automated device that individuals can use that enables them to change the fluids in their vehicle without requiring expensive assistance from a trained mechanic. Further, there is a need for a device that changes more than one fluid and a device that enables the operator to not only make the changes himself or herself, but enables him or her to easily transfer and collect the used or old fluids in safe containers so that they are not spilled or introduced into the environment unwittingly.

Perhaps the closest device, known to this inventor, is the Burrell et al. patent, U.S. Pat. No. 3,282,380 which utilizes an electrically powered motor to power a reversible pump for the purpose of providing an automatic oil changer. The device further includes a permanently mounted rotatable bracket in the engine compartment for use in holding an oil receptacle for receiving spent oil or an oil container for introducing new oil. Further, an electric interlock safety feature is connected to the operation of the ignition key that prevents draining the crank case oil while the engine is running. Other devices require fabrication of special parts for connection to not only the engine compartment, but the oil filter. See, for example, the Tilley patent, U.S. Pat. No. 3,991,854.

A drawback to these, and other electrically powered oil changing devices known in the art is that, in addition to the requirement for the fabrication of specialized parts, once these parts are connected to the vehicle the operator's use of the oil changing device is limited to that particular purpose. That is, none of the devices known in the prior art are either designed for, or have suggested, the use of their oil changing devices for the use and the transfer and removal of additional fluids such as motor oil, transmission fluid, engine coolant, water and power steering hydraulic fluid, for example. Thus, there is a need in the art for providing a fluid transfer mechanism that facilitates the work of changing all automobile fluids in vehicles, not simply oil, and that eliminates most of the difficulties encountered when draining the fluid out and pouring the new one back in. It, therefore, is an object of this invention to provide an improved fluid transfer system for vehicles for the transfer of fluids, such as oil, water, hydraulic fluid, etc., and for providing a mechanism and method for doing this, that is inexpensive and easy to use.

SHORT STATEMENT OF THE INVENTION

Accordingly, the fluid transfer mechanism of the present invention includes a frame having a pump therein which is moved by means of an electric motor. A suction conduit is mounted at one end to a suction port on the pump and a removably attachable second end is free to provide suction to fluid reservoirs. A discharge conduit is connected by one end to the discharge end of the pump and has a removably attached second end free to direct discharge fluids as manipulated by the operator. The mechanism further comprises an oil pan adapter connected, once only, to an oil pan to which the removably attachable second end of the suction conduit is attached for draining oil in the oil pan. Further, an oil cap adapter is connected to the oil cap of a vehicle so that the removably attachable second end of the discharge conduit may be attached thereto for adding oil to the vehicle. Further, more than one suction port and more than one suction conduit may be provided, with a switch on the pump so that suction is switchable from one suction conduit to the other. Plug/retaining pins are provided to secure the free ends of the suction and discharge conduits. Further, a new fluid suction device is provided for insertion into the new fluid container and connection, at the opposite end, to the second end of the suction conduit.

The method of the invention comprises the steps of attaching a frame to the vehicle for supporting a pump, with suction and discharge ports. A suction conduit is attached to the suction port leaving a removably attachable second end free to provide suction to fluid reservoirs and for attachment to the new fluid suction device. A discharge conduit is attached to the discharge port leaving a removably attachable second end free to direct discharge fluids as manipulated by an operator. Electrical connections are made for operation of the pump by the operator and the free end of the suction conduit is attached to the new fluid suction device attached to or inserted into, a replacement fluid reservoir. The free end of the discharge conduit is placed in a discharge fluid receptacle and the pump is operated until fluid is emptied from the reservoir. At that point, the pump is stopped and the free end of the suction conduit is placed in the replacement fluid container. The free end of the discharge conduit is placed in the emptied fluid reservoir and the pump is operated once again until the replacement fluid has filled the empty fluid reservoir. This method is modified when more than one suction port is provided and more than one suction conduit is utilized.

BRIEF DESCRIPTION OF THE DRAWINGS

Other objects, features and advantages of the present invention will become more fully apparent from the following detailed description of the preferred embodiment, the appended claims and the accompanying drawings in which:

FIG. 2 is a plan view of the invention without the frame;

FIG. 3 is a partial plan view showing the embodiment of the invention with one suction port;

FIG. 6A is a top view of the oil cap adapter for the present invention;

FIG. 6B is a partial sectional view taken along line A-A of FIG. 6A; and FIG. 6C is a plan view of the oil cap adapter.

DETAILED DESCRIPTION OF THE PREFERRED EMBODIMENT

Figure 1:
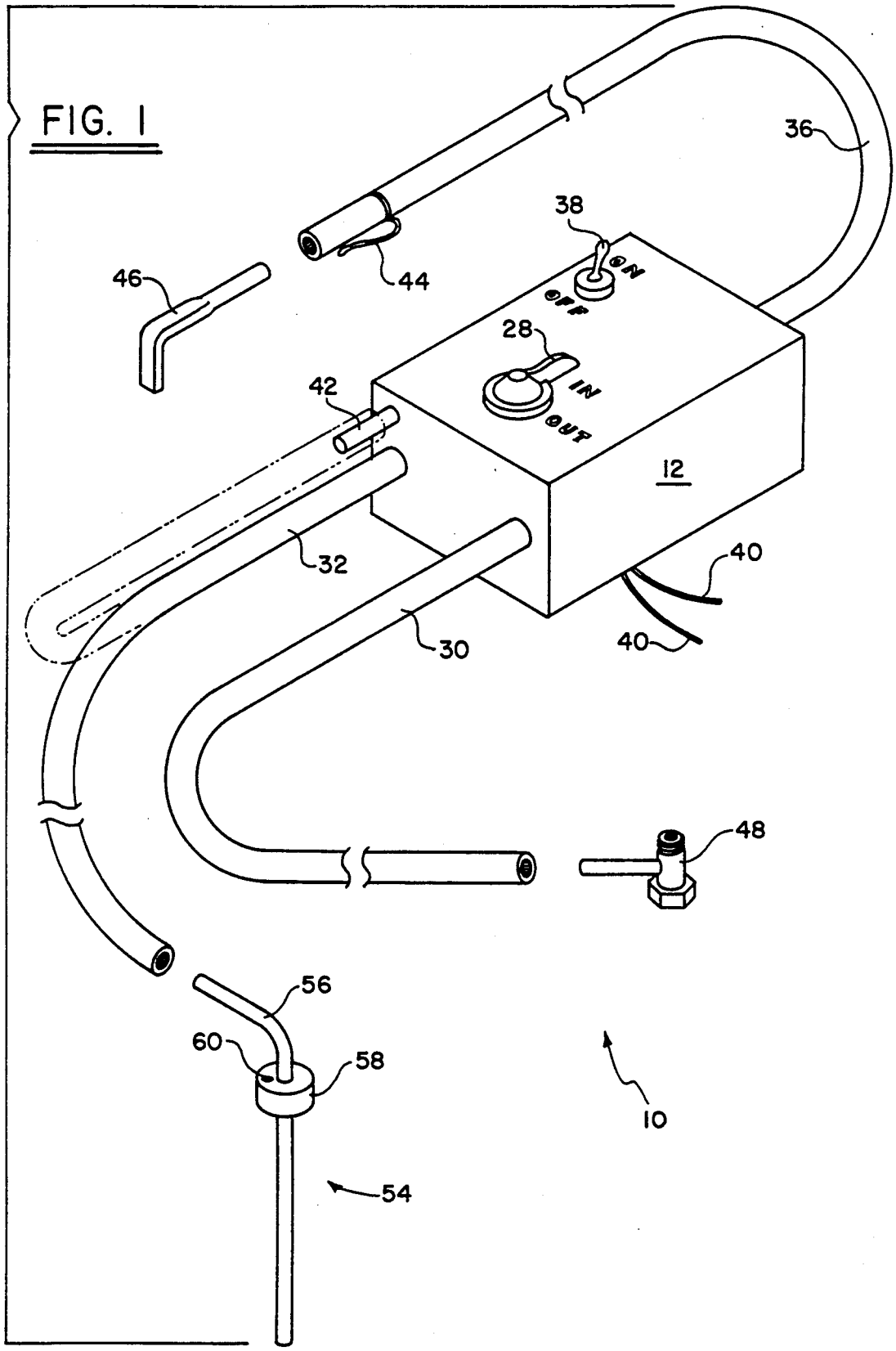
FIG. 1 is a plan view of a preferred embodiment of the fluid transfer system of the present invention with more than one suction port.

The preferred embodiment of the present invention is illustrated by way of example in FIGS. 1–6. With specific reference to FIGS. 1 and 2, a fluid transfer mechanism 10 includes a frame 12 which is in the form of a rectangular box. Recessed inside of the frame 12 is an electric diaphragm pump 14 with a discharge port 16 and suction port 18. FIG. 2 discloses elbow fitting 20 which is attached to suction port 18 so that two suction ports 22 and 24 are created. Elbow fitting 20 contains valve assembly 26, known in the art and not shown, so that by turning valve switch 28 suction can be directed to either suction port 22 or suction port 24. Suction conduits 30 and 32 are attached by one end to suction ports 22 and 24, respectively, by means of clamps 34 known in the art. Discharge conduit 36 is attached to discharge port 16 by means of clamp 34 as well. Electric on/off switch 38 is connected to electrical leads 40 which are in turn connected to the battery of the vehicle in a manner known in the art, not shown. Electric on/off switch 38 is mounted to the top of frame 12 and those positions are labeled appropriately.

FIG. 1 also shows plug/retaining pin 42 to which the free end of any one of the conduits may be attached for plugging and retaining when not in use. The dotted line shows suction conduit 32 attached to plug/retaining pin 42, for example. Additionally, FIG. 1 also illustrates conduit retaining clip 44 which is designed to limit the depth to which the conduit will penetrate a receptacle for suction or discharge of fluid. That is, conduit retaining clip 44 slips over the outside of the receptacle, see FIG. 4, such as an oil can or a cup of some sort, so that the free end does not drop far into the receptacle when fluid is being discharged thereto. FIG. 1 also illustrates oil cap adapter 46 and oil plug adapter 48. Both adapters are hollow to allow for the passage of oil. As illustrated, these adapters are designed to be attached to the vehicle one time and left in place. Nonetheless, they may be removed and replaced by the ordinary oil cap or oil plug should the operator choose to remove the device to another vehicle or for any other reason. Finally, FIG. 1 illustrates new fluid suction device 54 comprised of suction tube 56 and suction cap 58. A hole 60 is provided in cap 58 in order to equalize air pressure during use.

Figure 4:
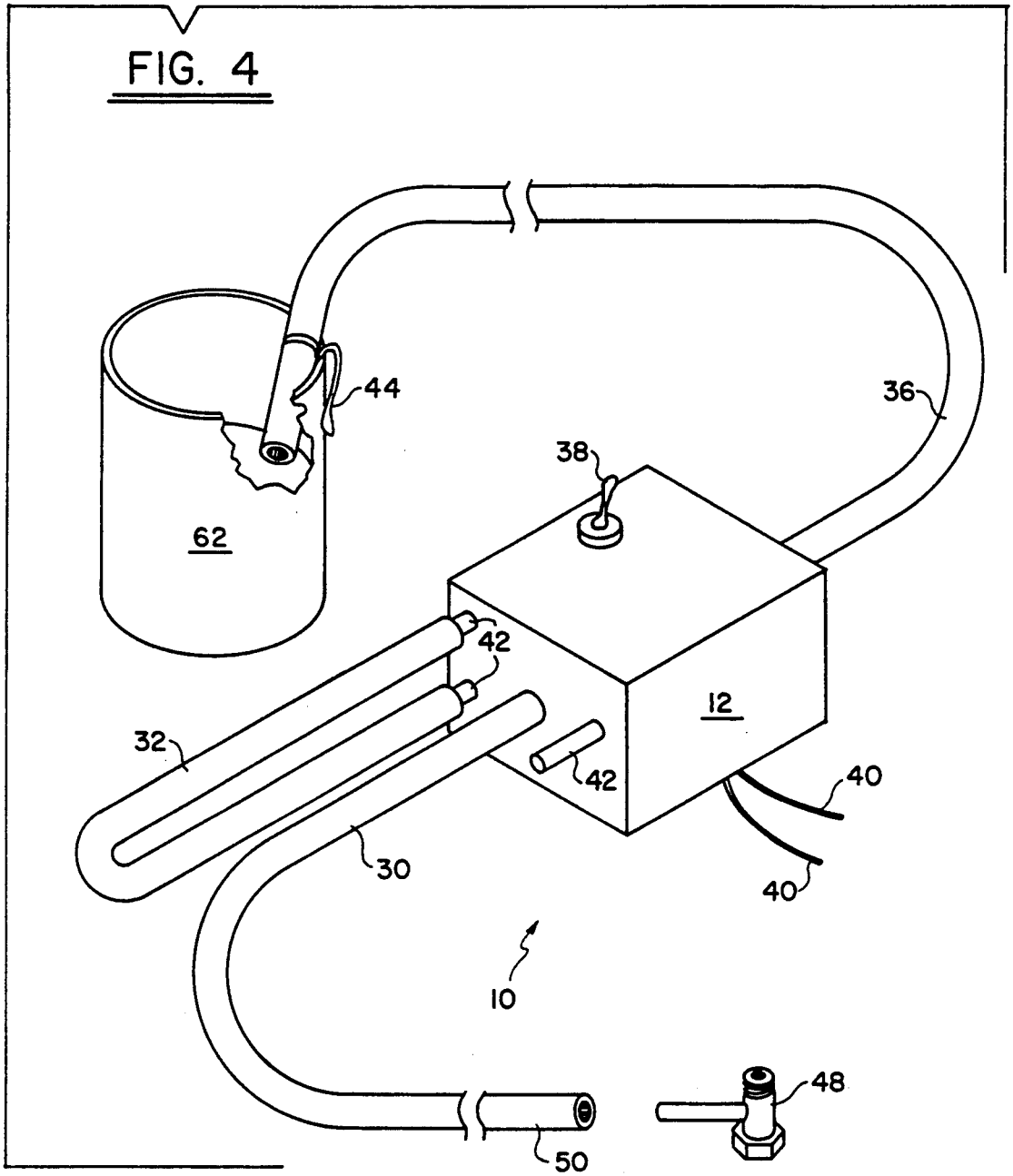
FIG. 4 is a plan view of the embodiment of FIG. 3 in position for emptying old oil.
Figure 5:
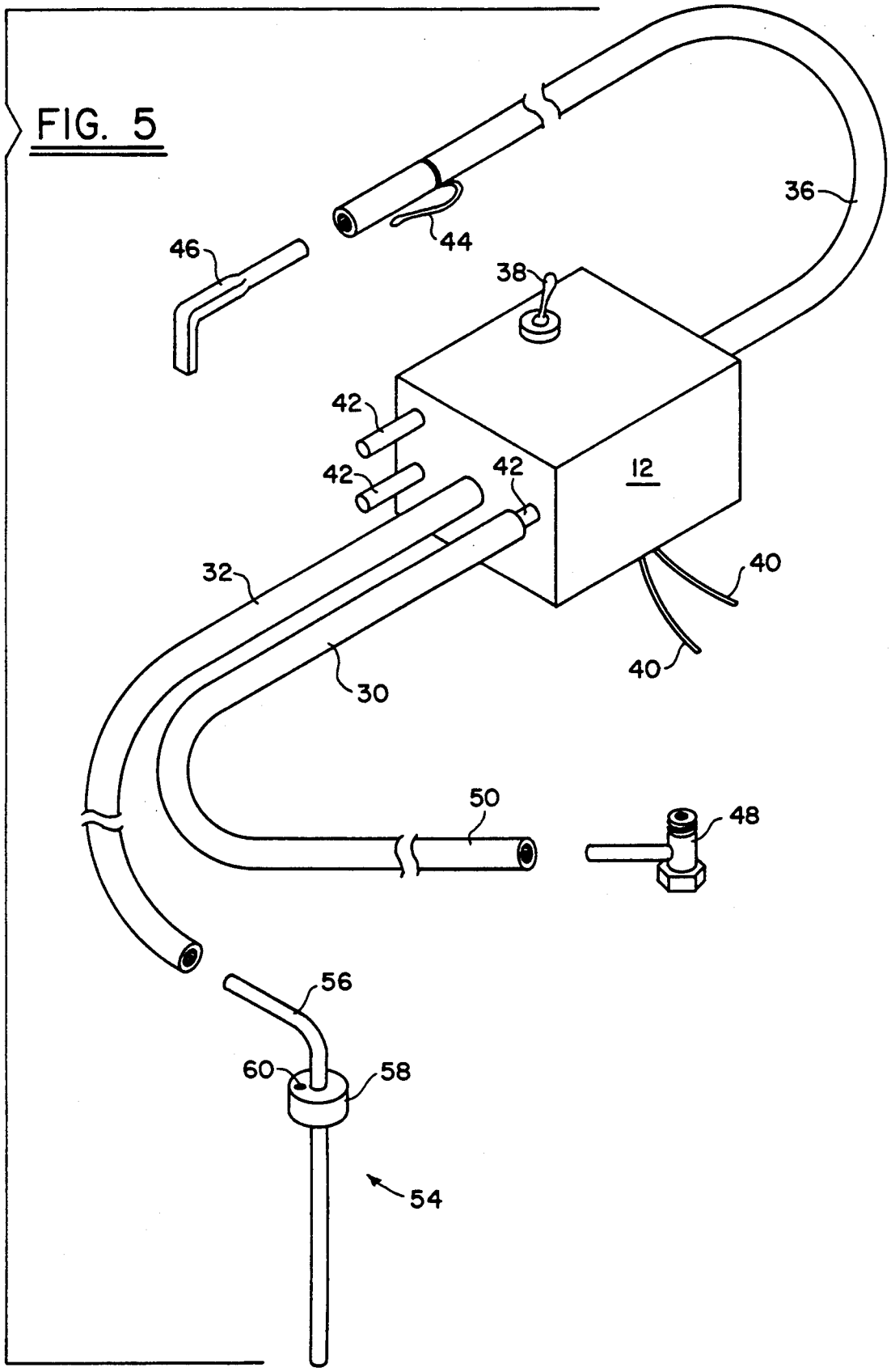
FIG. 5 is a plan view of the embodiment of FIG. 3 in position to add new oil.

Referring now to FIG. 3, another embodiment of the invention is disclosed wherein a single suction port 18 on electric diaphragm pump 14 is utilized. By means of utilization of a number of plug/retaining pins 42 on frame 12, suction conduit 30 and suction conduit 32 can still be utilized in the following manner. Referring to FIG. 4, with only one suction port, when oil is to be removed from the oil pan, suction conduit 30, attached by means of extension tube 50, for convenience in this instance, to oil plug adapter 48, is connected to suction port 18. With discharge conduit 36 connected to discharge port 16, when pump 14 is energized by means of an electric on/off switch 38, oil will be drained through the pump and discharged as directed by means of discharge conduit 36 into old oil/fluid container 62. Retaining clip 44 holds conduit 36 in place in the container 62 and prevents the end of conduit 36 from getting covered with old fluid. When the oil has been emptied to the operator's satisfaction, pump 14 is turned off and suction conduit 30 is removed from suction port 18 and placed on plug/retaining pin 42 and held in position thereby. Referring now to FIG. 5, at that point, suction conduit 32 can be attached to suction port 18 at one end and the free end attached to new fluid suction device 54 which has been screwed onto a new oil container, such as a plastic bottle of oil with a screw top. Once properly positioned, the discharge conduit 36 is once again attached to oil cap adapter 46 and the pump is energized. New oil is introduced into the vehicle until the proper amount is received and the device is then shut off. At this point, for safety, the operator would remove suction conduit 32 from suction port 18 and place the free end on plug/retaining pin 42. Suction conduit 30 would then be removed from plug/retaining pin 42 and placed on suction port 18. In this manner, without any intricate electrical mechanism interlock or the like, should the device be energized by an operator oil would simply be removed from the oil pan and introduced into the oil cap adapter and back into the engine without damaging the engine thereby. By this means a simple, safe, inexpensive and efficient safety device is provided that requires no complicated electrical ignition interlock system, such as is known in the art. However, even if this change had not been made and the pump had been energized, no damage to the engine would have occurred other than the introduction of air into the top of the oil cap adapter.

Referring now to FIGS. 6A, B and C, the oil cap adapter 46, is illustrated in the valve cover 47 known in the art. The oil cap 52, is simply removed, a slight cut 64 is made conforming to the adapter, the oil cap adapter is inserted and the oil cap 52 then repositioned. As shown in FIGS. 6B and 6C, the oil cap adapter has an end that extends into the fill opening and an end to which discharge conduit 36 is attachable. Further, the adapter is formed at an angle approximately midway between the two ends. As shown in FIG. 6B, the oil cap clamps down on the oil cap adapter and holds it in place. As a result, no further removal of the oil cap will ever be necessary as long as this addition is kept in place.

In the preferred embodiment, the operation of the device is as follows. Electric diaphragm pump 14 is attached to frame 12 and frame 12 to the vehicle as and where desired. Because of the small size of the device, Applicant's invention can be installed in many various locations and is, therefore, almost universally adapted to be located in any vehicle. Elbow fitting 20 is attached to suction port 18 so that dual suction ports 22 and 24 are provided. Suction conduits 30 and 32 are attached to suction ports 22 and 24 respectively and secured in position by means of clamps 34. Discharge conduit 36 is attached to discharge port 16. Once electrical leads 40 are connected to the electrical supply in a vehicle, electrical on/off switch 38 can be utilized to turn electric diaphragm pump 14 on and off. Valve switch 28 directs suction from suction port 22 to suction port 24 as desired by the operator. Oil cap adapter 46 and oil plug adapter 48 are placed in position for use as desired. For example, should the operator desire to change oil, suction conduit 30 is attached to oil plug adapter 48 to provide suction on the oil pan reservoir in the vehicle. Discharge conduit 36 is directed to an appropriate container for receipt of discharge oil. No physical contact with the oil is required nor is there any likelihood that oil would be spilled by utilization of this device, so that the environment is protected. As a result, the operator can run the engine of the vehicle to get the oil warm and then continue to heat the oil and thereby suspend the contaminants in the oil as much as possible prior to pumping. When the oil is desired to be pumped from the vehicle, the engine is turned off and electric diaphragm pump 14 is turned on. Once the oil is removed, valve switch 28 is turned to provide suction on suction port 24 and discharge conduit 36 is attached to oil cap adapter 46. Suction conduit 32 is attached to new fluid suction device 54 attached to an appropriate container holding new oil in the appropriate amount. At this point, electric pump 14 is turned on by means of switch 38 and oil is sucked through suction conduit 32 and discharged into the engine through discharge conduit 36 and oil cap adapter 46. Once again, oil is not physically touched by the operator and there is little or no likelihood that oil will be spilled when utilizing the device so that the environment is protected. Once the required amount of oil has been added to the vehicle, the device is turned off and the free end of suction conduit 32 may be placed on plug/retaining pin 42 and the device left in that manner until desired to be used again. At worst, if the device was turned on in this position the electric pump would have nothing to discharge and potentially all that would happen is that the motor would fail. Should the operator desire, at this point the valve switch 28 can be switched back to provide suction on suction port 22 and suction conduit 30 so that should electric switch 38 accidentally be turned on and the pump operated, oil would simply go from the pan to the oil cap adapter and into the engine with no damage to the pump or to the vehicle.

An even simpler, more compact and less expensive embodiment is illustrated in FIGS. 3, 4 and 5. Here there is simply one suction port 18 and a number of suction conduits 30 and 32 which are retained, when not in use, in position on frame 12 by means of a corresponding number of plug/retaining pins 42. The operation and method of changing the oil is similar to that described above where multiple suction ports are available, except that it is necessary to manually place the suction conduit 30 on suction port 18 in order to obtain suction on the desired conduit.

While the fluid transfer apparatus and method of the present invention has been disclosed in connection primarily with oil transfer, it should be appreciated that this fluid transfer system can be used for other fluids. Obviously, the device lends itself for the transfer of any automotive fluids in a safe and ecologically respectful manner. The present invention, therefore, provides an improvement which can be easily manipulated in order, for example, to change all of the fluids in the vehicle without coming into physical contact with them nor contaminating the environment. The mechanism is simple, reliable and safe and easily removable without seriously disrupting the other components in the engine compartment. Thus, the fluid transfer mechanism of the present invention has the important advantage of providing a safe and ecologically sensitive means for transferring fluids in a vehicle.

While the present invention has been disclosed in connection with the preferred embodiment thereof, it should be understood that there may be other embodiments which fall within the spirit and scope of the invention as defined by the following claims.

What is claimed is:

1. Fluid transfer mechanism comprising:

A. a frame;

B. a pump means, with a suction and a discharge port, mounted on said frame;

C. suction conduit with a first end connected to said suction port and a removably attachable second end free to provide suction to fluid reservoirs;

D. discharge conduit with a first end connected to said discharge port of said pump and a removably attachable second end free to direct discharged fluids as manipulated by an operator;

E. electrical connection means attached to said pump for operation of said pump as desired by said operator;

F. an oil pan adaptor means connected to an oil pan to which said removably attachable second end of said suction conduit is attached for draining oil in said oil pan;

G. an oil cap adaptor means connected to an oil cap to which said removably attachable second end of said discharge conduit is attached for adding oil;

H. a fill end, conformed to fit within a cut in an oil fill opening, passing into said oil fill opening; and I. a receiving end, conformed to receive said removably attachable second free end of said discharge conduit, communicatively formed to said fill end at an angle so that when a fill cap is inserted into said oil fill opening said fill cap clamps said oil cap adapter in place.

2. The mechanism of claim 1 further comprising a plurality of suction conduits, each removably attachable to said suction end of said pump, and wherein one of said suction conduit's second free end is connected to said oil pan adapter.

3. The mechanism of claim 2 wherein said pump means further comprises:

A. more than one suction port;

B. more than one suction conduit so that the free end of one of said suction conduits is connected to said oil pan adapter means; and C. switching means on said pump means so that suction is switchable from one of said suction conduits to another.

4. The mechanism of claim 3 further comprising a plug/retaining means attached to said frame so that said second free end of said suction conduits, not connected to said oil pan adapter, are removably attachable to said plug/retaining means and are thereby plugged and retained in place when not in use.

5. A fluid transfer method comprising the steps of:

A. attaching a frame to a vehicle;

B. mounting a pump means, with a suction and a discharge port, on said frame;

C. connecting a first end of a suction conduit to said suction port and leaving a removably attachable second end of said conduit free to provide suction to fluid reservoirs;

D. connecting a first end of a discharge conduit to said discharge port and leaving a removably attachable second end of said conduit free to direct discharged fluids as manipulated by an operator;

E. attaching electrical connection means to said pump for operation of said pump by said operator;

F. placing the free end of said suction conduit in a fluid reservoir;

G. placing the free end of said discharge conduit in a discharge fluid receptacle;

H. operating said pump until fluid is emptied from said fluid reservoir;

I. stopping the pump;

J. placing the free end of said suction conduit in a container of replacement fluids;

K. placing the free end of said discharge conduit in said emptied fluid reservoir;

L. operating said pump until said replacement fluid fills said emptied fluid reservoir;

M. connecting an oil pan adapter means to an oil pan to which said suction conduit is attached for draining oil from said oil pan; and N. connecting an oil cap adapter means to an oil cap to which said removably attachable second end of said discharge conduit is attached for adding oil.

6. The method of claim 5 comprising the further steps of:

A. providing a plurality of suction conduits, each removably attachable to said suction end of said pump; and B. connecting one of said suction conduit's free ends to said oil pan adapter.

7. The method of claim 6 comprising the further steps of:

A. providing more than one suction port on said pump; and

B. adding a switching means to said pump so that suction is switchable from one of said suction conduits to another.

8. The method of claim 7 comprising the further steps of:

A. attaching a plug/retaining means to said frame; and

B. other than the free end attached to said oil pan adapter, attaching the free end of said suction conduit to said plug/retaining means so that said free ends are plugged and retained in position when not in use.

9. The method of claim 5 further comprising the steps of:

A. constructing said oil cap adapter with a fill end, conformed to fit within a cut in an oil filled opening, passing into said oil fill opening; and B. constructing said oil cap adapter with a receiving end, conformed to receive said removably attachable second free end of said discharge conduit, communicatively formed to said fill end at an angle so that when a fill cap is inserted into said fill opening said fill cap clamps said oil cap adapter in place.

* * * * *

UNITED STATES PATENT AND TRADEMARK OFFICE

CERTIFICATE OF CORRECTION

PATENT NO. : 5,056,621

DATED : October 15, 1991

INVENTOR(S) : Arnold G. Trevino

It is certified that error appears in the above-identified patent and that said Letters Patent is hereby corrected as shown below:

In Claim 5, column 7, line 25 of the patent, change "fluids" to --fluid--.

In Claim 9, column 8, line 27 of the patent, change "filled" to --fill--.

Signed and Sealed this

Sixteenth Day of March, 1993

*Attest:*

STEPHEN G. KUNIN

*Attesting Officer*

*Acting Commissioner of Patents and Trademarks*